US005548908A

United States Patent [19]

Torborg et al.

[11] Patent Number: 5,548,908

[45] Date of Patent: Aug. 27, 1996

[54] BULKHEAD AND EXPANDED DRUM WITHOUT ROLLERS

[75] Inventors: Kevin Torborg; Victor E. Jelinek, both of Webster City, Iowa

[73] Assignee: White Consolidated Industries, Inc., Cleveland, Ohio

[21] Appl. No.: 489,843

[22] Filed: Jun. 13, 1995

[51] Int. Cl.[6] ..... F26B 11/02

[52] U.S. Cl. ..... 34/601; 34/602; 34/603

[58] Field of Search ..... 34/58, 595, 601, 34/602, 603

[56] References Cited

U.S. PATENT DOCUMENTS

| | | | |
|---|---|---|---|
| 2,855,698 | 10/1958 | Hutt | 34/108 |
| 2,927,380 | 3/1960 | Olthuis | 34/595 |
| 3,121,000 | 2/1964 | Hubbard | 34/75 |
| 3,570,138 | 3/1971 | Douglas et al. | 34/601 |
| 3,816,942 | 6/1974 | Smith | 34/242 |
| 3,875,686 | 4/1975 | Smoot | 34/242 |
| 4,069,596 | 1/1978 | Sisler | 34/242 |
| 4,430,809 | 2/1984 | Jackson et al. | 34/601 |
| 4,586,269 | 5/1986 | St. Louis | 34/601 |
| 4,669,200 | 6/1987 | Carr | 34/242 |
| 5,127,169 | 7/1992 | Ellingson | 34/133 |
| 5,216,823 | 6/1993 | Ripley | 34/133 |
| 5,257,448 | 11/1993 | Pearce et al. | 29/434 |
| 5,363,569 | 11/1994 | Kadakia | 34/601 |

*Primary Examiner*—John M. Sollecito
*Assistant Examiner*—Steve Gravini
*Attorney, Agent, or Firm*—Pearne, Gordon, McCoy & Granger

[57] ABSTRACT

An improved clothes dryer construction including a metal dryer drum, front and rear bulkheads, front and rear wear rings, and a plurality of wear pins. The dryer drum is generally cylindrical and provides front and rear annular lips over which the wear rings are mounted and which coaxially nests over a support ring provided by each of the bulkheads. The wear rings, which seal the space between the lips and the support rings, have a series of openings which align with apertures in the annular lips. The wear pins extend through the openings in the wear rings and are snap-fit into the apertures to secure the wear rings to the annular lips. The wear pins serve as a supplemental bearing to support the dryer drum should the wear rings wear out over time.

14 Claims, 4 Drawing Sheets

Fig.1
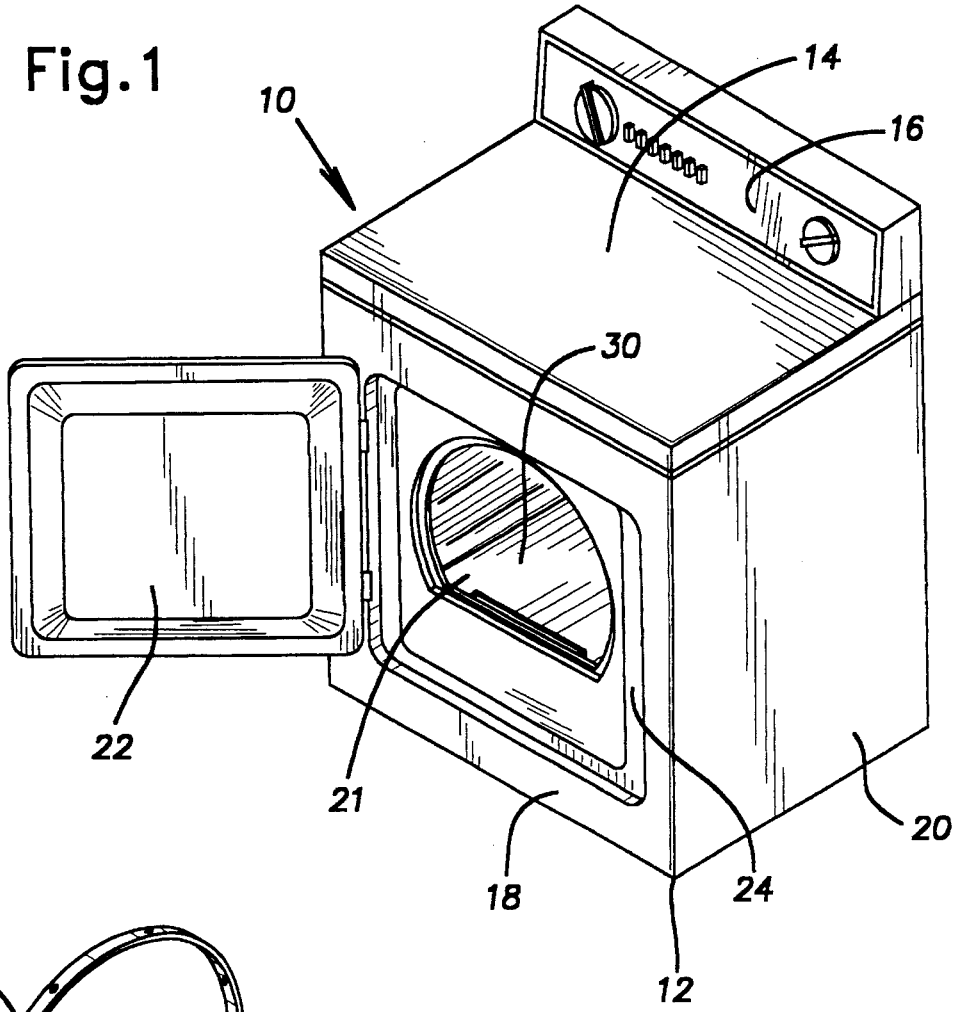
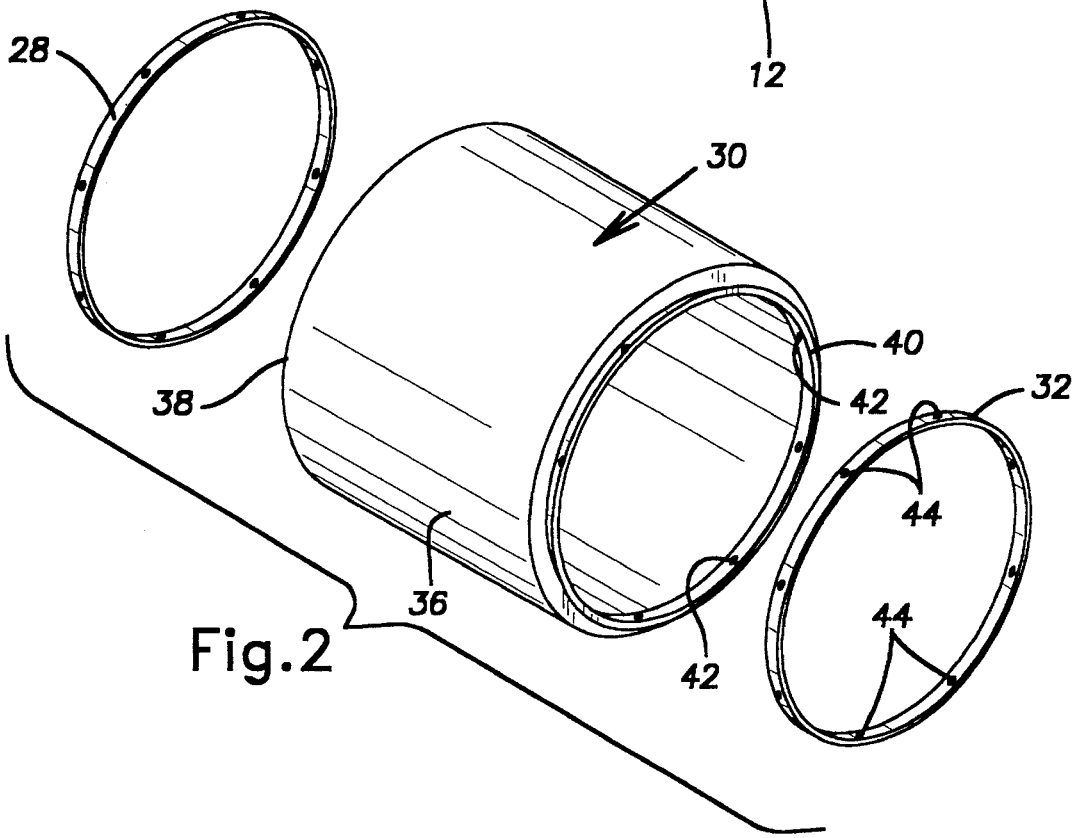
Fig.2

BULKHEAD AND EXPANDED DRUM WITHOUT ROLLERS

BACKGROUND OF THE INVENTION

As household clothes dryers have developed, various assemblies have been employed to mount the dryer drum for rotation within the clothes dryer cabinet. Each of these assemblies have attempted to solve numerous problems in the art, and have met with varying degrees of success.

The most common design problems encountered in the clothes dryer art include reliability, useful life, ease of assembly, noise generation and transmission, maintenance, and cost. Solutions to these problems are sometimes a conflicting. For example, while it may be possible to make a clothes dryer which is reliable and has a long life, in the past such a machine would require periodic maintenance, would be difficult to manufacture, and would have an excessive cost.

One conventional drum mounting scheme mounts each end of the dryer drum for rotation upon a pair of idler rollers. The front of the drum is enclosed, about its circular rim, by a front felt seal carried by a front bulkhead. The rear of the drum is likewise enclosed by a rear felt seal carried by a rear bulkhead. The front and rear bulkheads are each attached to the dryer cabinet. In such a construction, the front and rear bulkheads and seals do not bear any of the weight of the drum.. Rather, the dryer drum is supported entirely by the front and rear pairs of idler rollers.

Although reliable, the aforementioned assembly requires the installation and maintenance of several idler rollers, which increases the assembly time and parts cost and, hence, increases the resulting cost of the clothes dryer. Furthermore, the idler rollers tend to become noisy as they wear and require periodic maintenance and/or replacement.

One attempt to improve upon the aforementioned conventional dryer is exemplified in U.S. Pat. No. 5,216,823, which is owned by the assignee of the present invention and incorporated herein by reference in its entirety. The '823 patent eliminates the idler rollers which commonly support the front end of the dryer drum and, instead, uses a bearing and seal assembly which includes a ring-like felt seal positioned between the open circular front end of the drum and a circular support flange coaxially nested within the front end of the drum. An upper arcuate portion of the felt seal has a plurality of thin, pad-like glides of wear-resistant plastic material fixed thereto. The pads are engaged by the drum and bear the weight of the front end of the drum. The bearing and seal assembly of the '823 patent reduces noise transmission, cost, and maintenance as compared to conventional dryers.

U.S. Pat. No. 5,363,569, which is also owned by the assignee of the present invention and incorporated herein by reference, improves upon the '823 patent by providing a bearing and seal assembly formed from a two-piece ring of lubricant impregnated felt. The felt ring has an upper portion which is formed of a relatively high density felt to bear the weight of the front end of the drum, and a lower portion which is formed of a relatively lower density felt. The two-piece felt ring of the '569 patent prevents or minimizes transmission of noise from the drum to the surrounding metal cabinet, and decreases the assembly time and cost of the dryer.

Another type of dryer construction is presented by U.S. Pat. No. 5,127,169, incorporated by reference herein, wherein the dryer drum is rotatably mounted between a rear bulkhead provided by a back panel of the dryer cabinet and a front bulkhead attached to a front panel of the cabinet. The front and rear ends of the dryer drum are sealed by front and rear sealing gaskets. Idler rollers support the weight of the rear of the drum, thereby increasing the maintenance, noise generation and transmission, and cost of the clothes dryer.

There exists a need in the art for a clothes dryer which is easy to manufacture, which reduces or eliminates noise generation and transmission, and which can be produced at a low cost.

SUMMARY OF THE INVENTION

The present invention provides a clothes dryer assembly which reduces or eliminates transmission of noise from the dryer drum to the surrounding cabinet, which is easy to manufacture, and which is cost competitive.

In accordance with the present invention, a bearing and seal assembly includes a lubricant-impregnated felt wear ring which is mounted to an annular lip of a dryer drum by a plurality of wear pins. The wear ring defines a series of openings which are aligned with apertures in the annular lip. The wear pins extend through the openings in the felt ring and press or snap-fit into the apertures in the annular lip. The wear pins retain the felt ring in place and serve as auxiliary bearing members to support the dryer drum should the felt ring wear out.

In further accordance with the present invention, a clothes dryer assembly includes a drum, front and rear wear rings, and front and rear bulkheads. The drum has a cylindrical body from which extend front and rear annular lips. The front and rear bulkheads each include support rings over which the annular lips and the wear rings coaxially and rotatably nest. The front and rear wear rings are attached to the annular lips by wear pins and are in sliding engagement with the support rings.

BRIEF DESCRIPTION OF THE DRAWINGS

These and further features of the present invention will be apparent with reference to the following description and drawings, wherein:

FIG. 1 is a front perspective view of a clothes dryer incorporating the present invention;

FIG. 2 is an exploded rear perspective view of a dryer drum and front and rear wear rings according to the present invention;

DETAILED DESCRIPTION OF THE PREFERRED EMBODIMENT

Figure 3A:
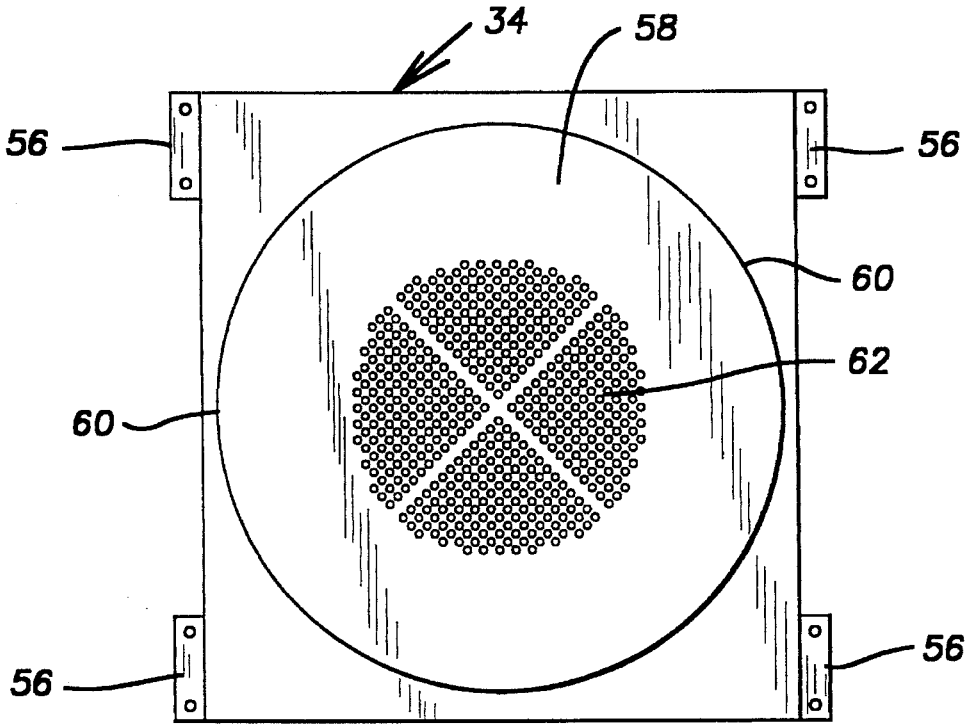
FIG. 3A is a front elevation of a rear bulkhead and rear cabinet panel;.

With reference to FIG. 1, a clothes dryer 10 incorporating the present invention is illustrated. The clothes dryer 10 has a box-like cabinet 12 formed from painted sheet metal. The dryer cabinet 12 includes a horizontal top panel 14 with a control console 16 extending along its rear edge. The control console 16 allows a user to regulate operation of the clothes dryer to provide drying of clothes placed within the dryer in a predetermined manner. The dryer cabinet 12 also includes a front panel 18, a pair of side panels 20 (one shown), and a rear panel (not shown).

The front panel 18 defines an access opening 21 which is closed by a door 22 hinged along its left edge for movement about a vertical axis, as illustrated. When the door is open as shown in FIG. 1, the user can reach through the access opening 21 and into the interior of the clothes dryer 10 to insert or remove clothing contained therein. The front panel 18 also provides a seat 24 against which the door 22 seals during operation of the dryer. A conventional switch (not shown) is provided adjacent the front panel 18 to preclude operation of the dryer 10 without closure of the door 22 against the front panel.

Figure 3B:
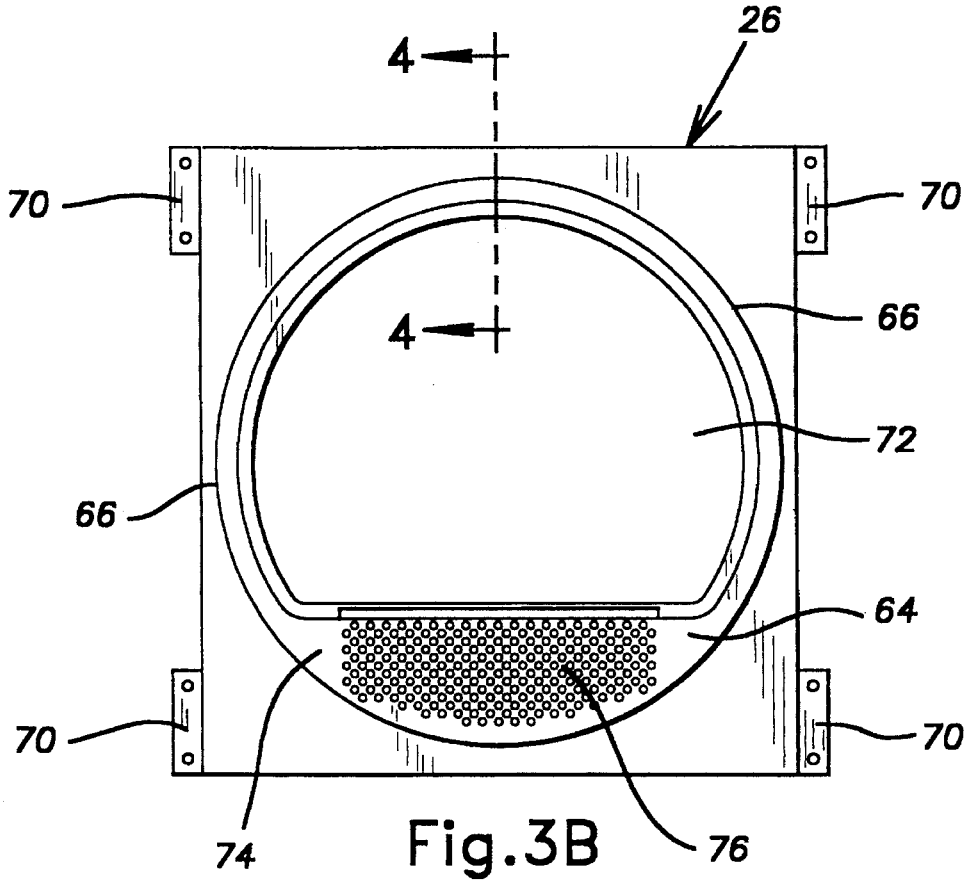
FIG. 3B is a rear elevation of a front bulkhead and a front cabinet panel.
Figure 3C:
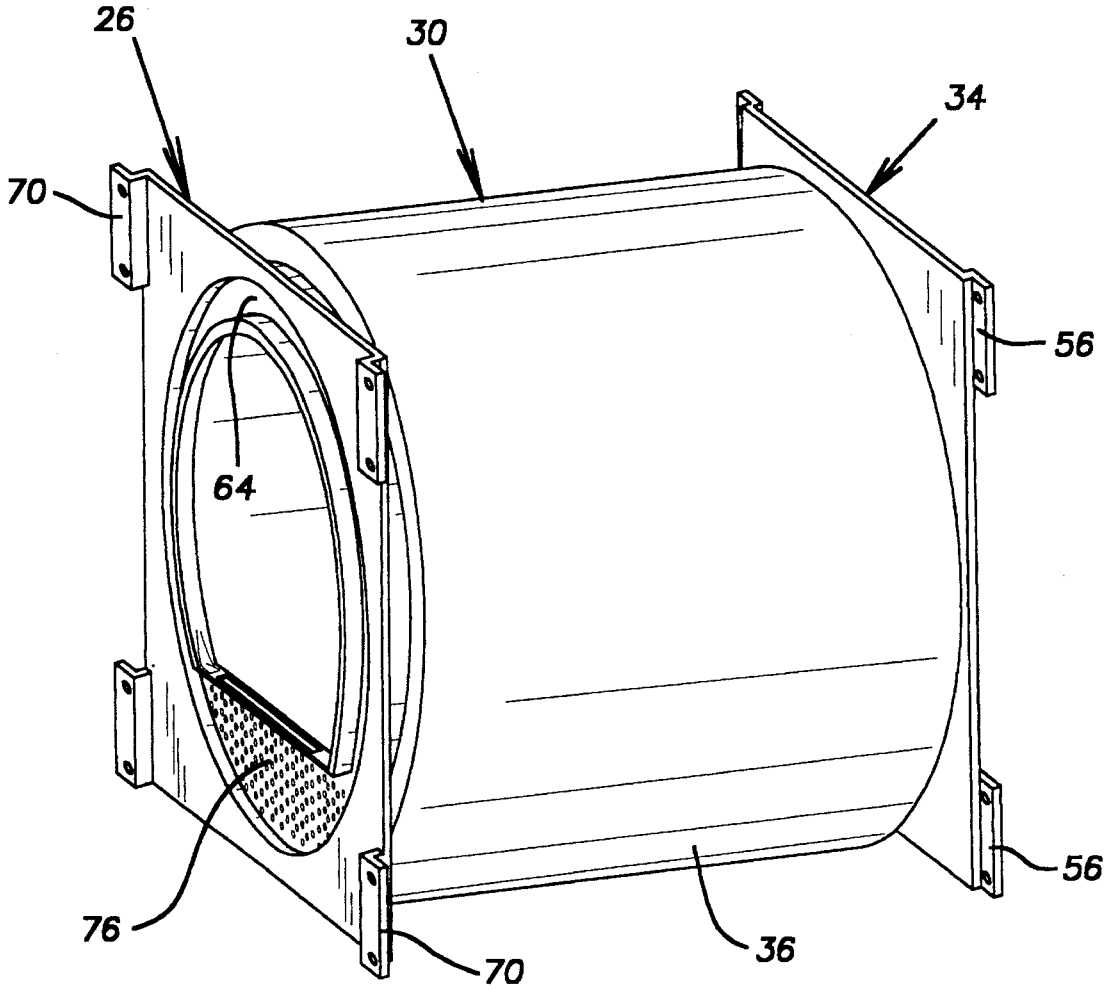
FIG. 3C is a perspective view showing the drum mounted between the front and rear bulkheads.
Figure 4:
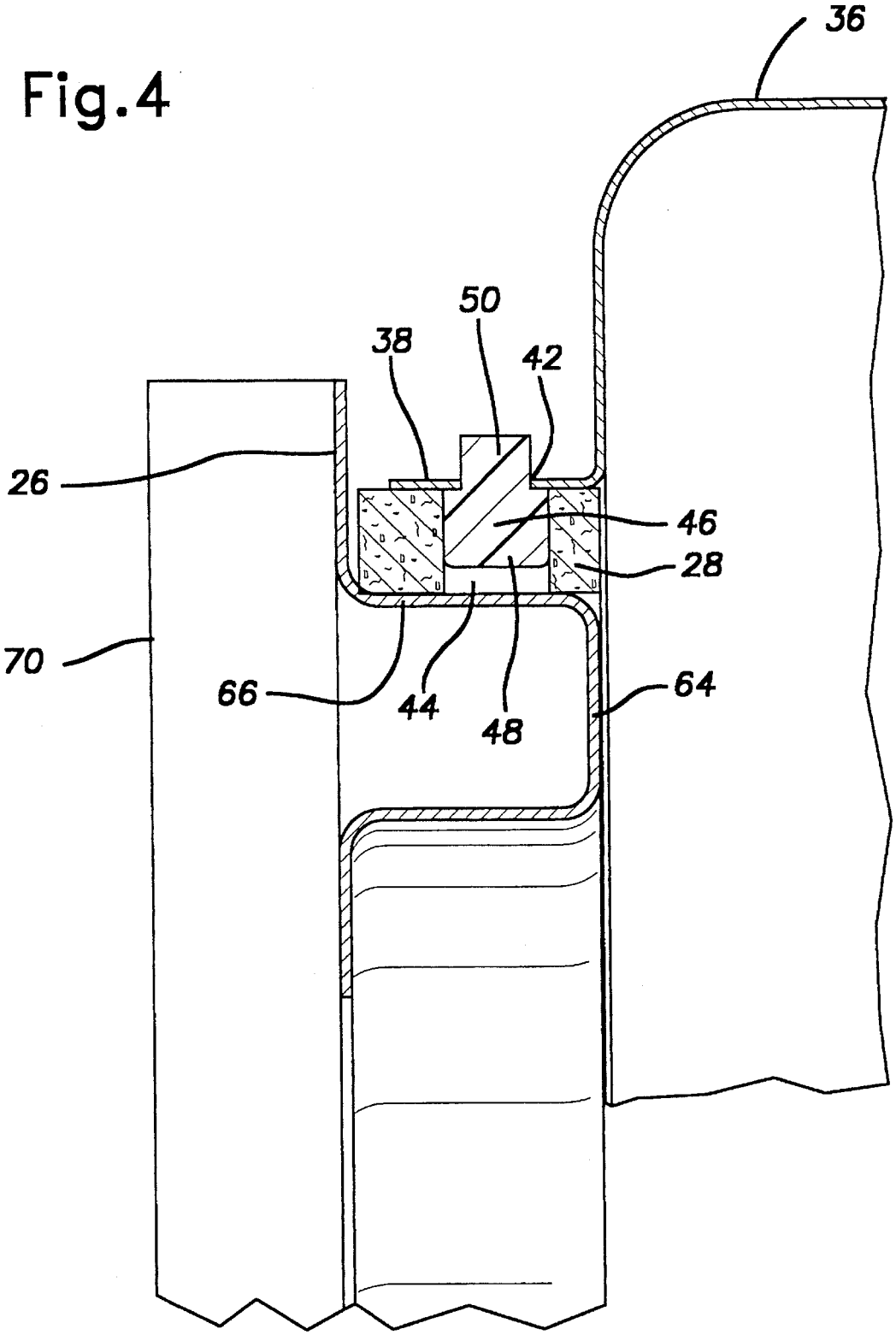
FIG. 4 is a cross-sectional view of the front bulkhead, drum, front wear ring, and a wear pin according to the present invention.

Turning to FIGS. 2–4, the clothes dryer 10 discussed with regard to FIG. 1 can be seen to include a front bulkhead 26, a front wear ring 28, a dryer drum 30, a rear wear ring 32, and a rear bulkhead 34.

With specific reference to FIG. 2, the dryer drum 30 is shown to have a generally cylindrical body 36 with front and rear circular or annular lips 38, 40. The front and rear lips 38, 40 preferably have a smaller diameter than the cylindrical body 36 of the drum 30, as illustrated. Each of the lips 38, 40 has a plurality of apertures 42 formed therein to facilitate mounting of a wear ring 28, 32 thereto, as will be described more fully hereafter.

The front and rear wear rings 28, 32 are preferably formed from a lubricant-impregnated felt material, preferably, high-density felt impregnated with graphite, "TEFLON", nylon, or the like, to withstand the weight of the drum bearing thereagainst while providing a reduced friction sliding surface and serving to seal any space or air gap between the annular lips 38, 40 and the bulkheads 26, 34.

The wear rings 28, 32 have a series of openings 44 formed therein which are aligned with the apertures 42 in the annular lips 38, 40. Preferably, the wear rings 28, 32 have a width dimension which is slightly greater than a width dimension of the annular lips 38, 40, as shown best in FIG. 4. The extra width of the wear ring 28, 32 serves to seal the space between the bulkheads 26, 34 and annular lips 38, 40 of the drum 30 and helps to absorb radial and longitudinal thrusts of the drum 30, which may be experienced during use and transport.

Wear pins 46 secure the wear rings 28, 32 to the annular lips 38, 40 of the drum 30. The wear pins 46 are preferably formed from a low friction, wear-resistant material, such as nylon or "TEFLON". As illustrated best in FIG. 4, each wear pin 46 has a head portion 48 which is received within the opening 44 in the wear ring 28, 32 and a pin portion 50 which extends through the aligned aperture 42 in the annular lip 38, 40 of the drum 30. Preferably, each wear pin 46 is slidably inserted through one of the wear ring openings 44 and snap-fitted into one of the apertures 42 in the annular lip 38, 40.

Longitudinal or circumferential ribs may be incorporated into the pin portion 50 to help prevent unintentional removal of the wear pin 46 from the annular lip 38, 40. The pin portion 50 may also be formed with screw-type threads to help retain the pin 46 within the lip 38,40. Alternatively, the pin portion 50 may be deformed (i.e., enlarged or swaged) by an impact, heat treatment, chemical treatment, or equivalent means after the wear pin 46 is installed in the annular lip 38, 40. However, ribs, threads, and deformation of the pin portion 50 is generally not necessary since friction between the lip 38, 40 and wear pins 46 retains the pins during assembly and, in use, centrifugal forces created by the rotating drum 30 force the head portion 48 of the wear pins 46 toward the annular lip 38, 40 and, therefore, discourages the pins 46 from falling out of the openings 44 and apertures 42.

It is noted that the head 48 of the wear pins 46 lies under a radially innermost surface of the wear rings 28, 32 (see FIG. 4). As such, the wear rings 28, 32 are not normally in contact with the bulkhead 26, 34 and will not transmit noise or vibration from the drum 30 to the bulkheads 26 and surrounding cabinet 12.

With reference to FIG. 3A, the rear bulkhead 34 is shown to have a generally square peripheral shape from which two pair of lateral mounting tabs 56 extend, as illustrated. The mounting tabs 56 allow the rear bulkhead 34 to be fastened to the rear panel (not shown) of the dryer cabinet 12.

The rear bulkhead 34 also provides an inwardly-directed central section 58 which includes a circular or annular peripheral surface defining a rear support ring 60 over which the rear annular lip 40 of the dryer drum 30 rotatably nests. More-specifically, the rear support ring 60 of the rear bulkhead 34 is rotatably engaged by a radially innermost surface of the rear wear ring 32. A series of air inlet openings 62 are formed in the central section 58 and permit air to be introduced through the rear bulkhead 34 and into the drum 30.

With reference to FIG. 3B, the front bulkhead 26 defines a generally square body having an inwardly-projecting central section 64 which includes a circular or annular peripheral surface defining a front support ring 66. The front bulkhead 26 includes two pairs of lateral mounting tabs 70 which are secured by conventional fasteners to the front edges of the cabinet side panels 20. The central section 64 of the front bulkhead 26 defines an opening 72 through which the operator may gain access into the interior of the dryer drum 30 (see FIG. 1).

The front annular lip 38 of the dryer drum 30 rotatably nests over the support ring 66 of the front bulkhead 26. More specifically, the front support ring 66 is rotatably engaged by a radially innermost surface of the front wear ring 28, as shown in FIG. 4. A bottom portion 74 of the central section 64 has a series of openings 76 through which air flows from the dryer drum 30 toward a blower or fan (not shown). The bottom portion 64 and the front panel 18 cooperate to define a slotted pocket which slidably receives a blade-type lint filter (not shown), as is well known in the art.

Turning to FIG. 3C, the dryer drum 30 is shown mounted between the front and rear bulkheads 26, 34. In use, heated air is drawn by the fan or blower (not shown) through a heater (not shown) and into the drum 30 via the openings in the rear bulkhead 34. The heated air moves through the drum 30 from back to front, through a blade-type lint filter carried within the pocket defined by the front panel 18 and the front bulkhead 26, through the blower, and through an exhaust duct (not shown) to atmosphere. The dryer drum 30 is rotatably supported via the front and rear lips 38, 40 solely by the front and rear wear rings 28, 32.

During use of the clothes dryer 10 according to the present invention, the weight of the drum 30 and the clothes therein is solely supported by the bulkheads 26, 34 via the wear rings 28, 32. The wear rings 28, 32 seal the space between the annular lips 38, 40 of the drum 30 and the bulkheads 26, 34 to prevent the escape of air therethrough. The wear rings 28, 32 also serve as a sound damper to prevent or minimize the transmission of noise generated within the drum 30 to the bulkheads 26, 34 and surrounding cabinet 12.

Should the wear rings 28, 32 deteriorate or wear out after a number of years of use, the weight of the drum 30 will be supported by the wear pins 46. More specifically, the wear pin heads 48 will slidably engage the annular surface of the support rings 60, 66. It is noted that the wear rings 28, 32 will not wear below the level of the wear pin heads 48 and, therefore, will continue to provide an effective air seal even though the weight of the drum is carried by the wear pins 46.

Although the preferred embodiment of the present invention is described herein, it should be noted that the present invention is capable of various modifications, rearrangements, and substitution of parts without departing from the scope and spirit of the present invention. For example, although the wear rings 28, 32 and wear pins 46 are disclosed herein as being attached to the drum 30, it is contemplated that the rings and pins could be attached, instead, to the support rings 60, 66 projecting from the bulkheads 26, 34.

What is claimed is:

1. An assembly for rotatably supporting a clothes dryer drum and for sealing a space between an annular lip of the drum and a support ring extending from a bulkhead, said assembly comprising a wear ring and a plurality of wear pins, said wear pins securing said wear ring to one of said annular lip or said support ring, wherein said wear ring seals the space between said annular lip and said support ring and rotatably supports the drum, and wherein said wear pins are formed from a low friction material.

2. An assembly according to claim 1, wherein said ring defines a series of openings which align with apertures in said one of said annular lip or said support ring.

3. An assembly according to claim 2, wherein said wear pins extend through said openings in said ring and are secured within said apertures.

4. An assembly according to claim 2, wherein said apertures are formed in said annular lip.

5. An assembly according to claim 4, wherein said wear pins extend through said openings in said ring and are secured within said apertures.

6. An assembly according to claim 5, wherein said wear pins are snap-fit into said apertures.

7. A clothes dryer assembly, comprising:

a drum having a generally cylindrical body from which front and rear annular lips extend;

a front wear ring secured to said front annular lip;

a rear wear ring secured to said rear annular lip;

a front bulkhead including an inwardly directed support ring; and a rear bulkhead including an inwardly directed support ring, wherein said front and rear wear rings are secured to the annular lips by wear pins, said wear pins being formed from a low friction material.

8. A clothes dryer assembly according to claim 7, wherein said drum is supported solely by said wear rings and said bulkheads.

9. A clothes dryer assembly according to claim 7, wherein said annular lips define a plurality of apertures which align with a plurality of openings in said wear rings, said wear pins extending through said wear rings and said apertures.

10. A support assembly for a clothes dryer drum, said drum having front and rear annular lips, said support assembly consisting of:

a rear bulkhead;

a front bulkhead;

a front wear ring located between said front bulkhead and said front annular lip; and a rear wear ring located between said rear bulkhead and said rear annular lip.

11. A support assembly for a clothes dryer drum according to claim 10, wherein said front wear ring is secured to said front annular lip.

12. A support assembly for a clothes dryer drum according to claim 11, wherein said front wear ring defines a plurality of openings which align with a plurality of apertures formed in said front annular lip, said openings and apertures receiving pins to secure said front wear ring to said front lip.

13. A support assembly for a clothes dryer drum according to claim 10, wherein said rear wear ring is secured to said rear annular lip and said front wear ring is secured to said front annular lip, each of said wear rings defining a plurality of openings which align with a plurality of apertures formed in said annular lips, said openings and apertures receiving pins to secure said wear rings to said lips.

14. A support assembly for a clothes dryer drum according to claim 13, wherein said wear rings are formed from a lubricant impregnated felt material.

* * * * *